US005934159A

United States Patent [19]

Robichaud

[11] Patent Number: 5,934,159

[45] Date of Patent: Aug. 10, 1999

[54] OPENER FOR PACKAGE CLOSURE

[75] Inventor: Arthur W. Robichaud, Kittery, Me.

[73] Assignee: SIG Combibloc, Inc., Columbus, Ohio

[21] Appl. No.: 09/020,774

[22] Filed: Feb. 9, 1998

[51] Int. Cl.[6] ..... B67B 7/16; B67B 7/00; B67B 7/04

[52] U.S. Cl. ..... 81/3.36; 81/3.55; 81/3.57; 81/3.47; 81/3.48

[58] Field of Search ..... 81/3.47, 3.48, 81/3.55, 3.36, 3.57; 222/81, 83

[56] References Cited

U.S. PATENT DOCUMENTS

| | | | |
|---|---|---|---|
| 4,864,898 | 9/1989 | Tricinella . | |
| 4,915,290 | 4/1990 | Robichaud et al. . | |
| 4,934,590 | 6/1990 | Robichaud et al. . | |
| 4,949,600 | 8/1990 | Tricinella . | |
| 5,033,141 | 7/1991 | Kang . | |
| 5,062,328 | 11/1991 | Demurger . | |
| 5,101,999 | 4/1992 | Robichaud et al. . | |
| 5,127,121 | 7/1992 | Bossie . | |
| 5,224,618 | 7/1993 | Garbiso | 220/269 |
| 5,299,714 | 4/1994 | Kilgore | 222/81 |
| 5,390,567 | 2/1995 | Martorell . | |
| 5,467,896 | 11/1995 | Hols | 222/83 |

*Primary Examiner*—David A. Scherbel
*Assistant Examiner*—Philip J. Hoffmann
*Attorney, Agent, or Firm*—Standley & Gilcrest LLP

[57] ABSTRACT

The present invention is an opener for a package closure. The opener is designed to work with a push tab that has a depressable end which may pierce the package. The opener has a handle and a protrusion. The protrusion may be attached to the handle, or the protrusion may be attached to an angled portion which is attached to the handle. The protrusion is adapted to be positioned on the depressable end of the push tab. The opener may also include a prong which is adapted to fit in an air vent of the push tab. The prong may be attached to the handle, or the prong may be attached to an angled portion which is attached to the handle. The protrusion is spaced from the prong so that it is positioned on the depressable end of the push tab when the prong is positioned in the air vent. When the protrusion is positioned on the depressable end of the push tab, the user may apply sufficient downward force to the handle of the opener in order to cause the depressable end of the push tab to pierce and open the package.

15 Claims, 4 Drawing Sheets

OPENER FOR PACKAGE CLOSURE

BACKGROUND AND SUMMARY OF THE INVENTION

This invention relates generally to an opener for packages and containers for food and beverages, and more particularly, to an opener for resealable package closures having a push tab which may pierce the package.

One type of container for food and beverages is a box-like package having a flat top. The top has a scored area which can be broken inwardly to open the package. These containers have been used most commonly for juices (and are frequently referred to as "juice boxes"), but they can be used for other beverages and foods such as soups, gravies, and other semi-liquids. A closure can be fitted over the scored area to assist in opening and to reseal the package to maintain the freshness of the contents after opening.

An example of a resealable package closure which is commonly used on these aseptic packages is disclosed in U.S. Pat. No. 5,101,999, which is assigned to Combibloc, Inc., the assignee of the present application. The disclosure of U.S. Pat. No. 5,101,999 is incorporated herein by reference. The closure device of U.S. Pat. No. 5,101,999 includes a base attached to the top of the package over a scored area. The base has a rearward portion and a forward portion. A central open area extends longitudinally between the rearward portion and the forward portion. The central open area is initially covered by a substantially rigid push tab which is pivotally connected to the rearward portion of the base. The push tab has a hinged end and a depressable end. The depressable end is disposed over the central open area of the base prior to opening the package, and it is pivotally movable through the central open area to open the package. The hinged end portion of the push tab often has a vent hole to allow air to enter the package providing a more even flow when pouring.

The package is usually opened when someone pushes on the depressable end of the push tab with a finger until the depressable end pierces the scored area and rotates into the package. As the depressable end rotates into the package, the person's finger may enter the package. This creates a potentially unsanitary condition. Any germs on the person's finger could be transferred to the contents of the package. Therefore, a need exists for a tool which could be used to open the package closure without a person's finger entering the package.

The present invention is designed to meet this objective. In general, the present invention provides an opener tool for opening a package such as the one described above. The opener is designed to work with a push tab that has a depressable end. A preferred embodiment of the opener has a handle and a protrusion attached to the handle. The protrusion is adapted to be positioned on the depressable end of the push tab. The protrusion preferably extends from the handle at angle. In addition, the protrusion may have an angled lower surface, and the protrusion may be substantially cylindrical. A user may apply sufficient downward force to the handle when the protrusion is positioned on the depressable end in order to cause the depressable end to pierce and open the package.

The above-described opener may also include a prong which is adapted to fit in an air vent on the hinged end of the push tab. The prong is attached to the handle, and the prong may extend from the handle at an angle. The protrusion is spaced from the prong so that it is positioned on the depressable end of the push tab when the prong is positioned in the air vent.

Another preferred embodiment of the opener is designed to work with a hinged push tab that has a depressable end. In this embodiment, the opener generally includes a handle, an angled portion, and a protrusion. The angled portion is attached to the handle. The protrusion is attached to the angled portion, and the protrusion is adapted to be positioned on the depressable end of the hinged push tab. As a result, sufficient force applied to the handle causes the depressable end of the hinged push tab to pierce and open the package.

In this embodiment of the opener, it is preferred that the protrusion extends substantially perpendicularly from the angled portion. In addition, the protrusion may have an angled lower surface, and the protrusion may be substantially cylindrical. This embodiment may also include a prong which extends from the angled portion. The prong may extend substantially perpendicularly from the angled portion, and the prong may be adapted to reside in an air vent hole of the hinged push tab.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 1:
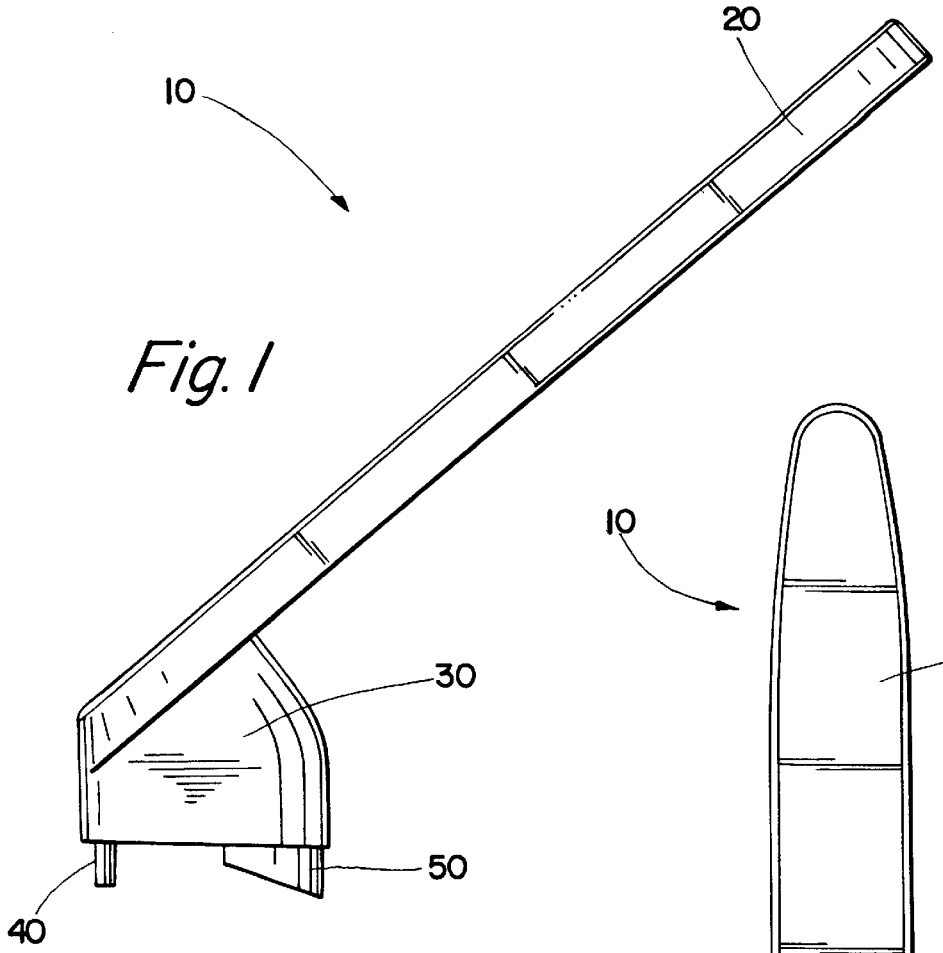
FIG. 1 is a side elevation view of a preferred embodiment of the opener of the present invention.
Figure 3:
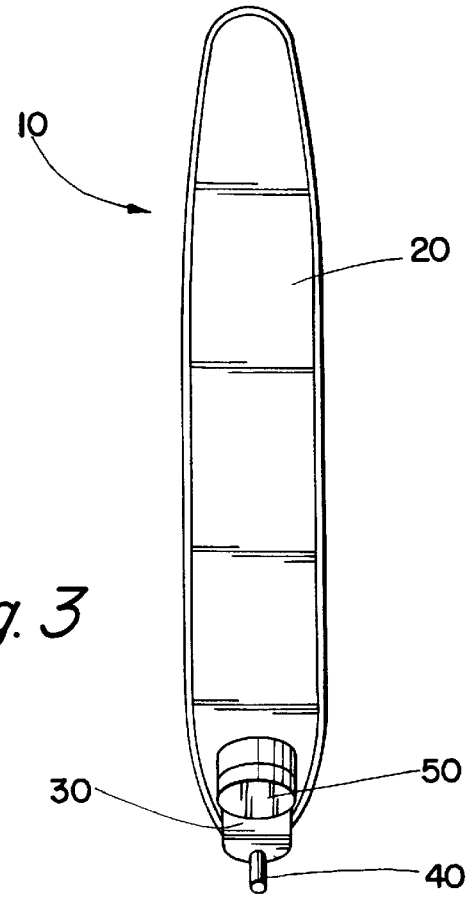
FIG. 3 is a perspective view of the opener shown in FIG. 1.
Figure 2:
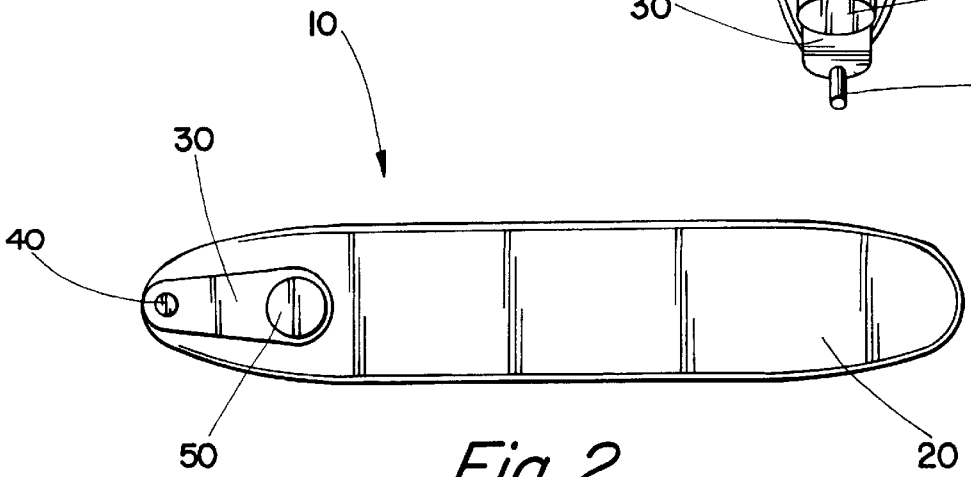
FIG. 2 is a bottom plan view of the opener shown in FIG. 1.
Figure 4:
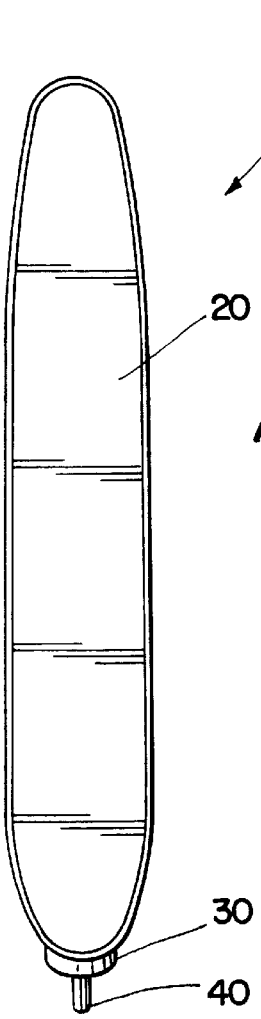
FIG. 4 is a perspective view of the opener shown in FIG. 1.
Figure 5:
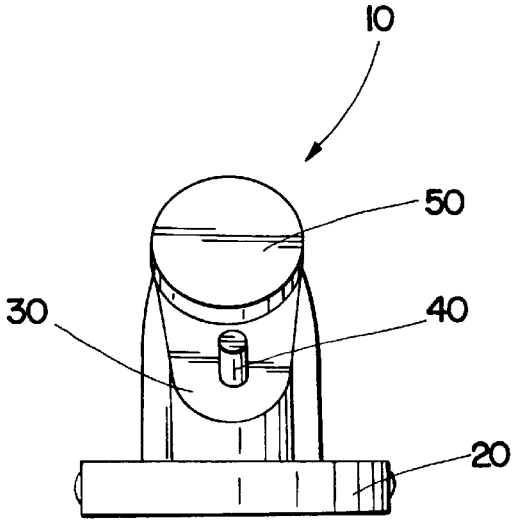
FIG. 5 is an end elevation view of the opener shown in FIG. 1.

An opener for a package closure is disclosed. In a preferred embodiment of the invention, the package closure has a push tab which may be used to pierce the package. The push tab has a depressable end. The opener has a handle and a protrusion. The protrusion is attached to the handle, and it is adapted to be positioned on the depressable end of the push tab. The protrusion preferably extends from the handle at angle. In addition, the protrusion may have an angled lower surface, and the protrusion may be substantially cylindrical. A user may apply sufficient downward force to the handle when the protrusion is positioned on the depressable end in order to cause the depressable end to pierce and open the package.

The hinged end of the push tab may have an air vent. The opener may have a prong which is adapted to fit in the air vent. The prong is attached to the handle, and it may extend from the handle at an angle. The protrusion is spaced from the prong so that it is positioned on the depressable end of the push tab when the prong is positioned in the air vent.

Another preferred embodiment of the opener is designed to work with a hinged push tab that has a depressable end. In this embodiment, the opener has a handle, an angled portion attached to the handle, and a protrusion attached to the angled portion. It is preferred that the protrusion extends substantially perpendicularly from the angled portion. In addition, the protrusion may have an angled lower surface, and the protrusion may be substantially cylindrical. The protrusion is adapted to be positioned on the depressable end of the hinged push tab so that sufficient downward force applied to the handle causes the depressable end to pierce and open the package.

This embodiment of the opener may further comprise a prong which is adapted to reside in an air vent on the hinged push tab when the protrusion is positioned on the depressable end of the hinged push tab. The prong may extend from the angled portion. In fact, it is preferred that the prong extends substantially perpendicularly from the angled portion.

FIGS. 1 through 5 show a preferred embodiment of the opener. The opener 10 has a handle 20. An angled portion 30 is attached to the handle 20. A prong 40 is attached to one end of the angled portion 30, and a protrusion 50 is attached to the other end of the angled portion 30. The angle of the angled portion 30 is measured between the longitudinal axis of the handle 20 and the bottom surface of the angled portion 30. The angle is preferably about 45 degrees, but any angle can be used which enables the opener 10 to force the push tab into an open position. The prong 40 and the protrusion 50 extend substantially perpendicularly from the bottom surface of the angled portion 30. In addition, the lower surface of the protrusion 50 is angled relative to the bottom surface of the angled portion 30.

The prong 40 is designed to fit in the air vent of a package closure. The protrusion 50 is spaced from the prong 40 so that when the prong 40 is in the air vent, the protrusion 50 will be positioned on the depressable end of the push tab.

Figure 6:
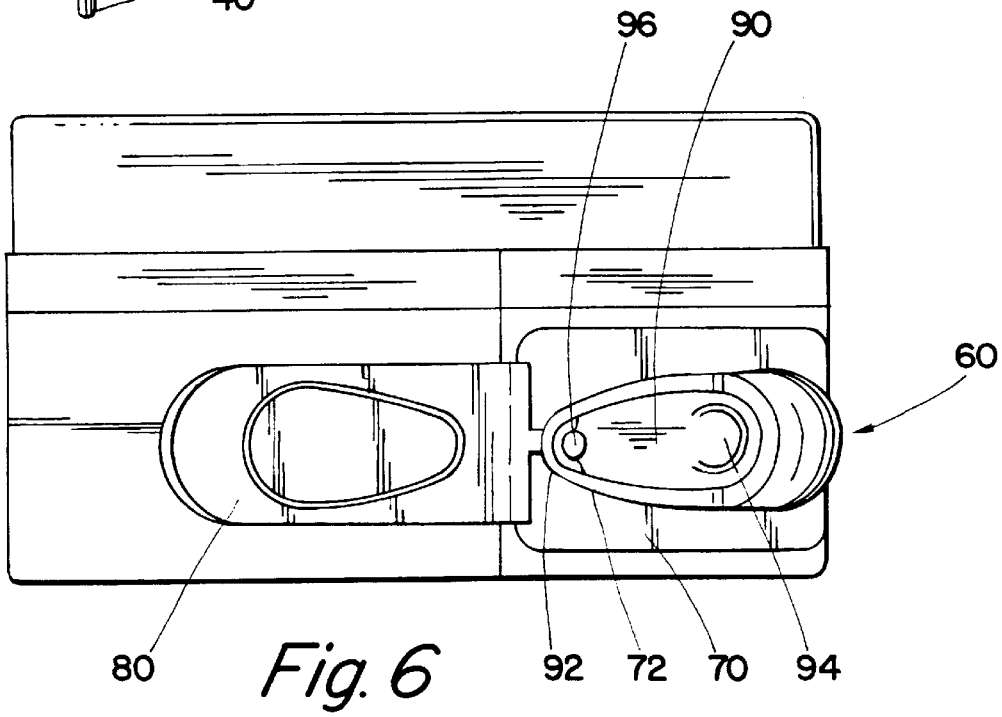
FIG. 6 is a top plan view of a typical package closure with which the opener shown in FIG. 1 is designed to work.

The embodiment shown is designed to work in conjunction with a package closure of the type shown in FIG. 6. The package closure 60 has a base 70 with a raised wall 72. The closure 60 may also have a cover 80 for resealing the package after it has been opened. There is a push tab 90 covering most of the central opening defined by the raised wall 72. The push tab 90 has a hinged end 92 and a depressable end 94. On the hinged end 92, there may be an air vent 96. When the prong 40 of the opener is placed into the air vent 96 of the closure 60, the protrusion 50 is positioned over the depressable end 94 of the push tab 90.

Figure 7:
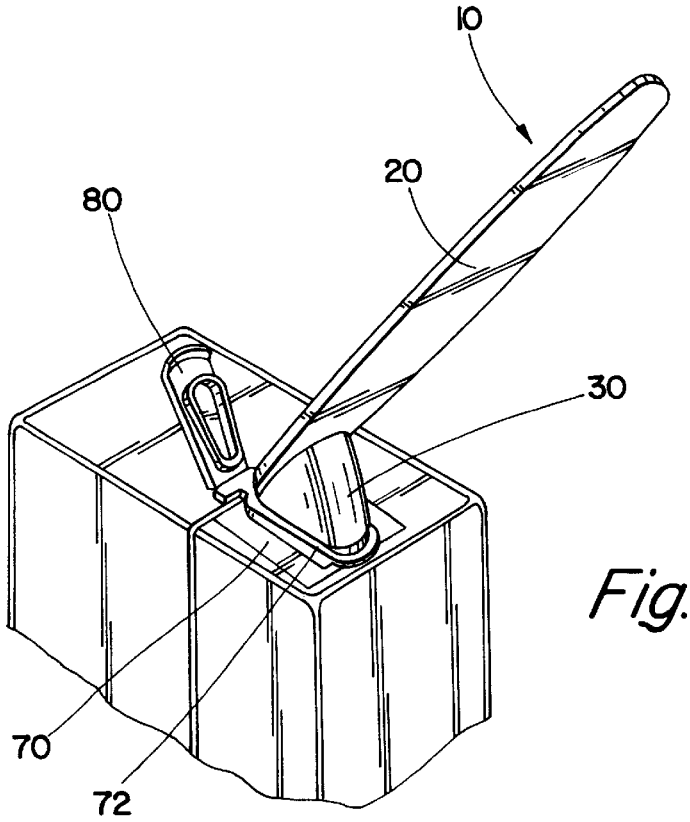
FIG. 7 is a perspective view of the opener shown in FIG. 1 in position on a package closure.
Figure 8:
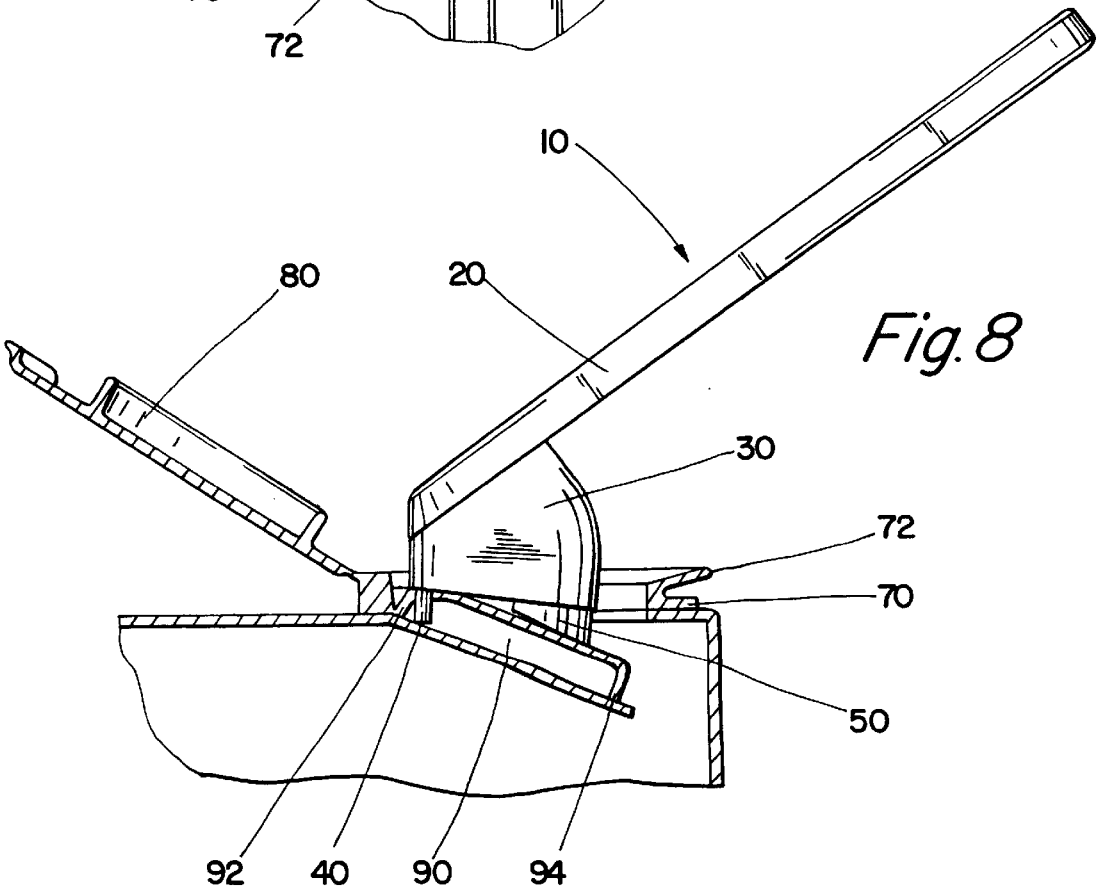
FIG. 8 is a cross-section view of the opener shown in FIG. 1 and a push tab in a partially open position.
Figure 9:
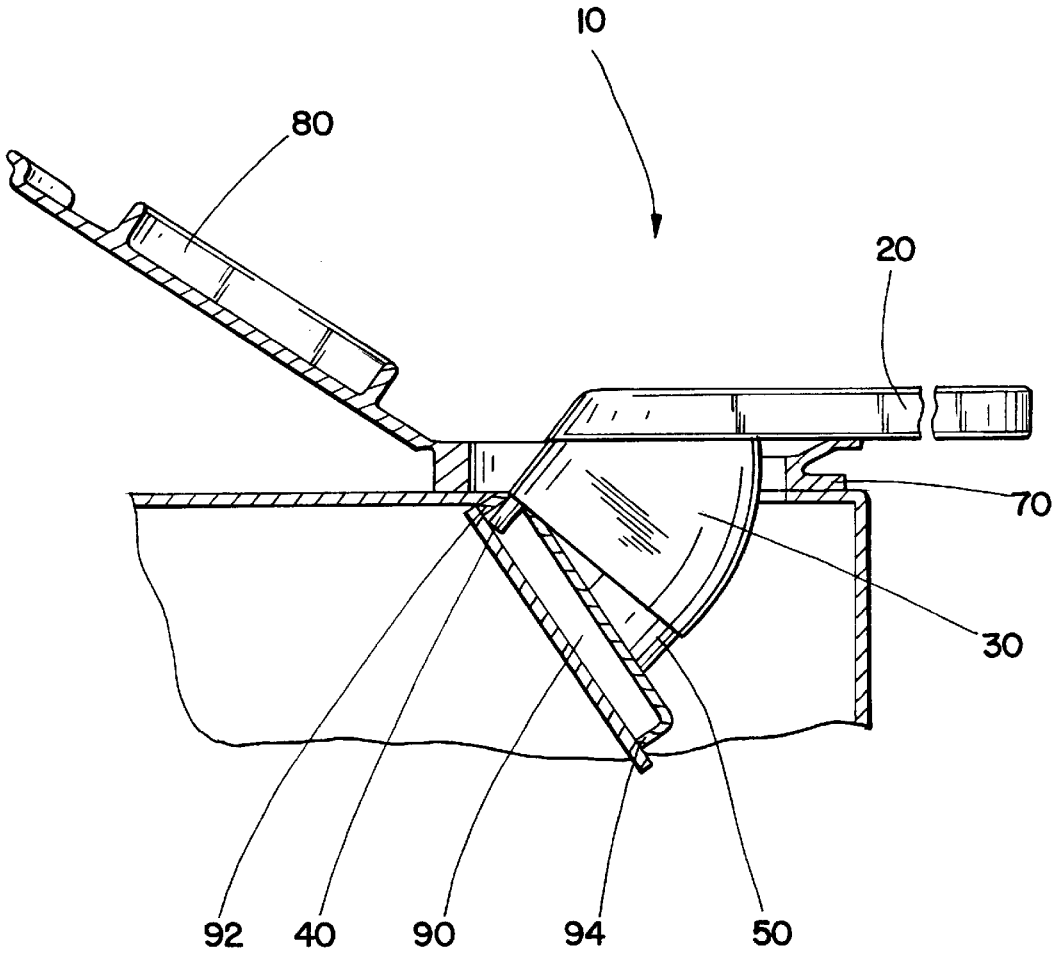
FIG. 9 is a cross-section view of the opener shown in FIG. 1 and a push tab in an open position.

FIGS. 7, 8, and 9 show the operation of the opener 10. FIG. 7 shows the opener 10 positioned on the closure 60. In FIG. 8, the handle 20 of the opener 10 has been depressed slightly so that the push tab 90 has begun to rotate into the package. FIG. 9 shows the handle 20 fully depressed, and the push tab 90 is rotated into the package such that it is in an open position. The opener 10 can then be removed from the package. After the opener 10 has been removed from the package, the contents of the package may then be dispensed. The entire use of the opener 10 may be accomplished with one hand applying force to the handle 20.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A package opening system comprising:

a package;

a package closure apparatus including a push tab having a depressable end, said package closure apparatus secured to said package;

a separate handle; and a substantially cylindrical protrusion attached to said handle, said protrusion adapted to be positioned on said push tab;

whereby sufficient force applied to said handle when said protrusion is positioned on said depressable end causes said depressable end to pierce and open said package.

2. A package opening system comprising:

a package;

a package closure apparatus including a push tab having a depressable end, said package closure apparatus secured to said package;

a handle separate from said package and said package closure apparatus, said handle having an upper end portion and a lower end portion; and a protrusion attached to said lower end portion of said handle, said protrusion adapted to be positioned on said push tab;

whereby sufficient downward force applied to said upper end portion of said handle when said protrusion is positioned on said depressable end causes said depressable end to pierce and open said package.

3. The package opening system of claim 2 wherein said protrusion has an angled lower surface.

4. The package opening system of claim 1 wherein said protrusion extends from said handle at an angle.

5. An opener for a package closure, said package closure having a push tab for piercing a package, said push tab having a hinged end and a depressable end, said hinged end having an air vent, said opener comprising:

a handle;

a prong attached to said handle and adapted to fit in said air vent; and a protrusion attached to said handle and spaced from said prong such that when said prong is positioned in said air vent, said protrusion is positioned on said depressable end of said push tab;

whereby sufficient force applied to said handle when said protrusion is positioned on said depressable end causes said depressable end to pierce and open said package.

6. The opener of claim 5 wherein said protrusion has an angled lower surface.

7. The opener of claim 5 wherein said protrusion is substantially cylindrical.

8. The opener of claim 5 wherein said protrusion extends from said handle at an angle.

9. The opener of claim 5 wherein said prong extends from said handle at an angle.

10. An opener for a package closure, said package closure having a hinged push tab which may pierce a package, said opener comprising:

a handle having an upper end portion and a lower end portion;

an angled portion attached to said lower end portion of said handle; and a protrusion attached to said angled portion, said protrusion adapted to be positioned on a depressable end of said hinged push tab;

whereby sufficient downward force applied to said upper end portion of said handle when said protrusion is positioned on said depressable end causes said depressable end to pierce and open said package.

11. The opener of claim 10 wherein said protrusion has an angled lower surface.

12. The opener of claim 10 wherein said protrusion extends substantially perpendicularly from said angled portion.

13. An opener for a package closure, said package closure having a hinged push tab which may pierce a package, said opener comprising:

a handle;

an angled portion attached to said handle; and a substantially cylindrical protrusion attached to said angled portion, said protrusion adapted to be positioned on a depressable end of said hinged push tab;

whereby sufficient force applied to said handle when said protrusion is positioned on said depressable end causes said depressable end to pierce and open said package.

14. An opener for a package closure, said package closure having a hinged push tab which may pierce a package, said opener comprising:

a handle;

an angled portion attached to said handle;

a protrusion attached to said angled portion, said protrusion adapted to be positioned on a depressable end of said hinged push tab; and a prong extending from said angled portion, said prong adapted to reside in an air vent of said hinged push tab;

whereby sufficient force applied to said handle when said protrusion is positioned on said depressable end causes said depressable end to pierce and open said package.

15. The opener of claim 14 wherein said prong extends substantially perpendicularly from said angled portion.

* * * * *